US005167750A

United States Patent [19]

Myers

[11] Patent Number: 5,167,750

[45] Date of Patent: Dec. 1, 1992

[54] HEAT SEALING MACHINE

[75] Inventor: David A. Myers, Connellsville, Pa.

[73] Assignee: Stahl's Special Projects, Inc., Connellsville, Pa.

[21] Appl. No.: 598,654

[22] PCT Filed: Feb. 8, 1989

[86] PCT No.: PCT/US89/00568

§ 371 Date: Jan. 10, 1991

§ 102(e) Date: Jan. 10, 1991

[87] PCT Pub. No.: WO90/09276

PCT Pub. Date: Aug. 23, 1990

[51] Int. Cl.[5] ..... B30B 15/04; B30B 15/34

[52] U.S. Cl. ..... 156/583.9; 100/93 P; 100/219; 100/233; 100/266; 100/283; 219/243

[58] Field of Search ..... 156/583.1, 583.7, 583.8, 156/583.9; 100/93 P, 219, 233, 266, 280, 283; 219/243

[56] References Cited

U.S. PATENT DOCUMENTS

| | | | |
|---|---|---|---|
| 2,624,389 | 1/1953 | Bungay | 156/583.9 X |
| 3,450,031 | 6/1969 | Peterson | 100/93 P |
| 3,823,054 | 2/1972 | Balzer et al. | 156/530 |
| 3,923,590 | 12/1975 | Humphries | 156/583.9 X |
| 3,982,418 | 9/1976 | Leavesley et al. | 73/11 |
| 4,055,456 | 10/1977 | Carnegie, Jr. | 156/366 |
| 4,190,485 | 2/1980 | Takeda et al. | 156/583.9 |
| 4,243,470 | 1/1981 | Higashiguchi | 156/583.9 |
| 4,378,266 | 3/1983 | Gerken | 156/359 |
| 4,421,589 | 12/1983 | Armini et al. | 156/583.9 X |
| 4,469,545 | 9/1984 | Löw | 156/359 |
| 4,713,047 | 12/1987 | Klinkel | 493/34 |

FOREIGN PATENT DOCUMENTS 2170443 8/1986 United Kingdom .

*Primary Examiner*—Michael G. Wityshyn
*Attorney, Agent, or Firm*—Brooks & Kushman

[57] ABSTRACT

A heat sealing machine for imprinting garments and the like has a base (10) carrying a lower, horizontal platen (18) above which an upper heated platen may swing from an open, generally vertical position at the rear of the lower platen to a closed position superimposing the lower platen with the upper platen (24) being carried by lever arm (28) pivoted at (26) adjacent its rear end with over-center locking and force multiplying linkage (82, 84 and 96, 98) operatively connected by actuating links (90, 92) to a relatively movable handle mechanism (70) whereby as the handle is swung downwardly to close the upper platen, during the last increments of such closure, relative downward movement of the handle with respect to the platen causes the over-center and force multiplying linkage (82, 84 and 96, 98) to squeeze the upper platen against the lower platen. Threaded member (62) is provided for adjusting the pressure imposed by the upper platen.

10 Claims, 4 Drawing Sheets

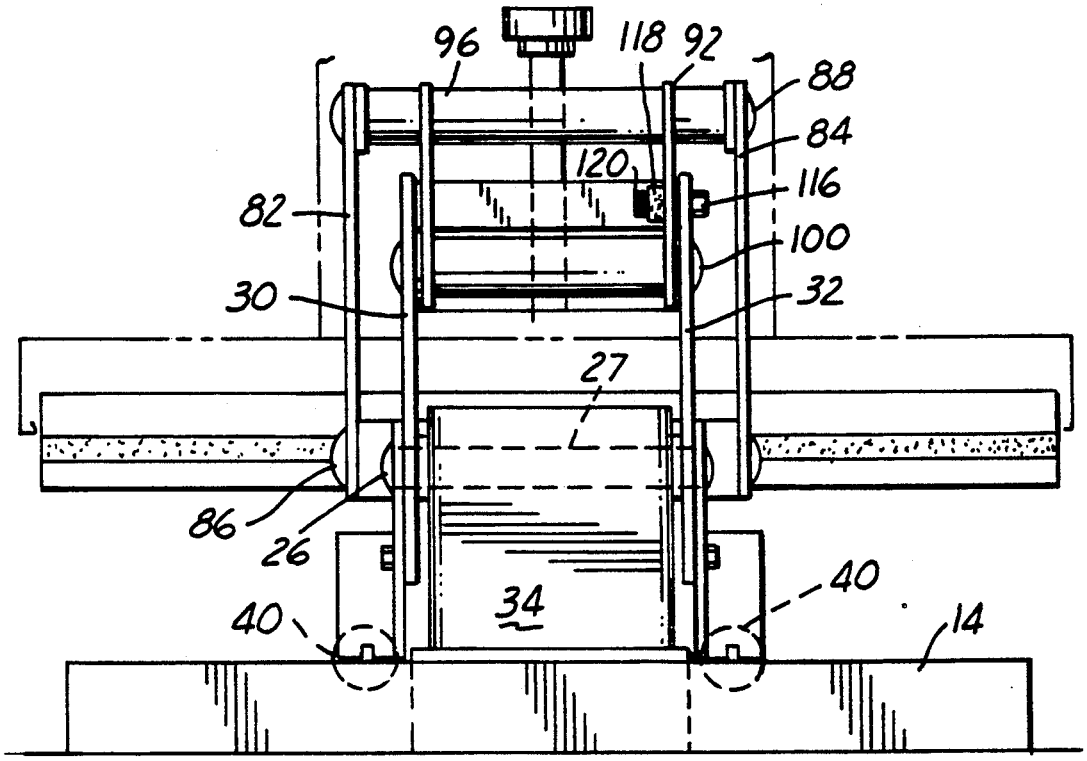
FIG.4
FIG.5
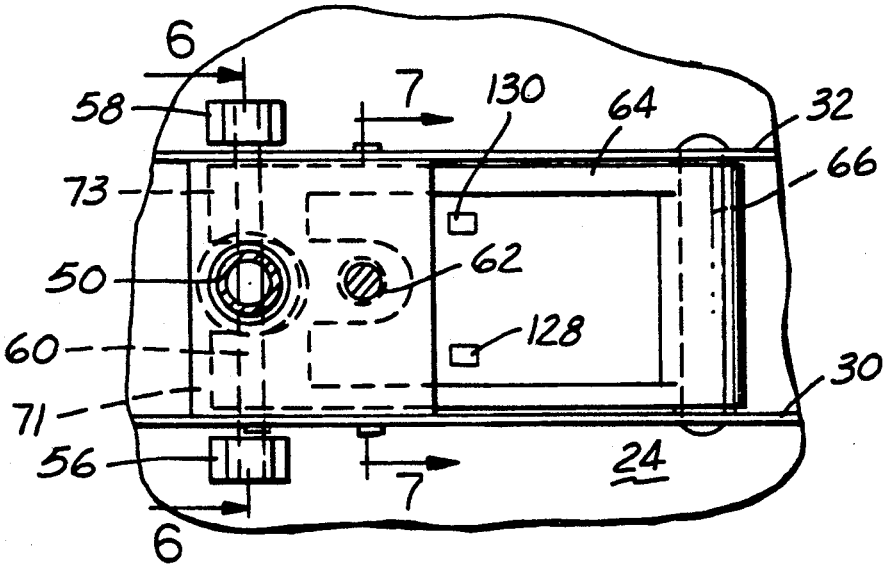

HEAT SEALING MACHINE

RELATED APPLICATIONS

This application incorporates by reference the disclosure of PCT applications Ser. No. PCT/US88/00409 filed Jan. 29, 1988 for HEAT SEALING APPARATUS and PCT/US88/04021 filed Nov. 9, 1988 for CAP SEALING MACHINE.

BACKGROUND OF THE INVENTION

With the increasing interest in heat-applied lettering, numerals, and other indicia on fabrics of all kinds, it has become desirable to provide an efficient and compact heat sealing machine which may be used by a shopkeeper or the like in the normal course of business as an adjunct to garment sales. To enable such a machine to be used readily by essentially unskilled workers, it is desirable that the machine be simple and foolproof in its operation so that a garment salesperson may, while a customer waits, imprint the garment with the selected letter, numeral or other indicia.

Heat sealing machines of various types have appeared on the market for several years, but for the most part have been difficult to operate successfully particularly by unskilled workers and such machines have not been well-suited to the wide variety of fabrics and the indicia which may be applied thereto now in vogue. Accordingly, there has been a need for the provision of a machine which may be readily operated with a minimum of instruction to imprint fabrics while a customer waits, such being carried out, for example, by the salesperson as a part of the garment sale. Desirably, the machine should be of compact form, occupy minimal counter space and be capable of programming by the operator in accordance with the requirements for the particular garment or indicia to be applied thereto. The guesswork in applying the indicia to the garment generally involved in the prior art machines should be, to as great an extent as possible, eliminated from a machine of the character under consideration.

The following U.S. Patents show heat sealing machines representative of relevant prior art, but none of these is satisfactory for the particular purpose intended:

U.S. Pat. No. 2,644,151 (Krueger);
U.S. Pat. No. 3,035,510 (Carpenter, et al);
U.S. Pat. No. 3,454,741 (Stewart);
U.S. Pat. No. 3,925,139 (Simmons);
U.S. Pat. No. 3,923,590 (Humphries);
U.S. Pat. No. 3,979,248 (Kussmaul);
U.S. Pat. No. 4,386,993 (Matsuo);
U.S Pat. No. 4,421,589 (Armini, et al).

SUMMARY OF THE INVENTION

The improved heat sealing machine disclosed herein includes a base on which is mounted a horizontal lower platen on which the garment and the indicia to be imprinted thereon are arranged. An upper platen is mounted on the base for swingable movement from a substantially vertical position at the rear of the lower platen to a position superimposing the lower platen The upper platen is heated. A handle is mounted at the front of the upper platen by which the operator may raise and lower the platen. The handle is connected to an over-center linkage mechanism for locking the upper platen firmly against the lower platen to apply pressure to the garment and the indicia disposed between the platens. The over-center linkage arrangement is such that during the last increments of closing movement of the upper platen against the lower platen the pressure between the platens is multiplied. Arranged atop the upper platen is a control center at which the operator may input operating data such as the temperature of the upper platen, the time the platens are to remain closed to effect the heat sealing and the control center will provide a visual readout to the operator of the temperature of the upper platen, the time remaining for the heat sealing closure of the platens and the pressure between the platens. An input device arranged atop the upper platen permits the operator to adjust the pressure between the platens to the desired amount. In operation, the machine signals the operator when the machine has reached the selected temperature and upon closure of the platens the closure time is automatically measured and an audible and visual signal is provided when the time has expired. In addition the operator may visually note the pressure between the platens as well as the temperature.

BRIEF DESCRIPTION OF THE DRAWINGS

FIG. 4 is a cross-sectional view of the linkage supporting the upper platen taken along the line 4—4 of FIG. 3;

FIG. 5 is a cross-sectional view taken along the line 5—5 of FIG. 3;

BRIEF DESCRIPTION OF THE PREFERRED EMBODIMENT

Figure 1:
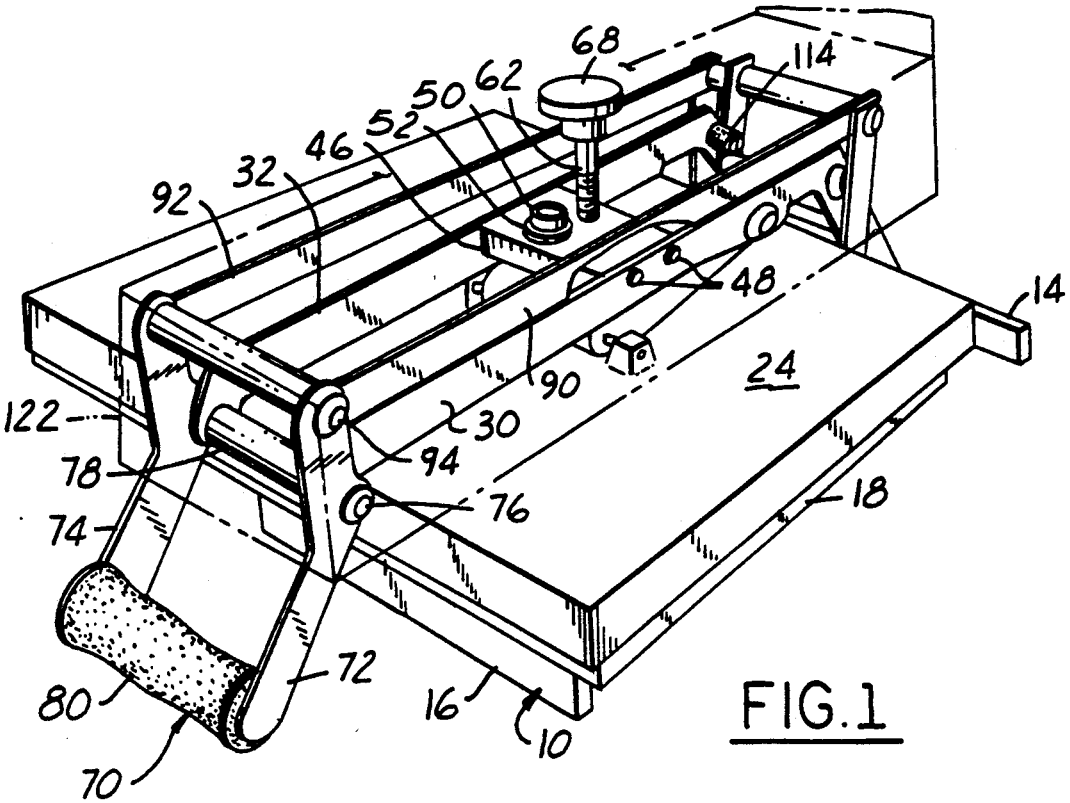
FIG. 1 is a perspective view from the front, right hand corner of a heat sealing machine embodying the invention with the cover for the linkage and the control center removed, and its outline shown in phantom.
Figure 2:
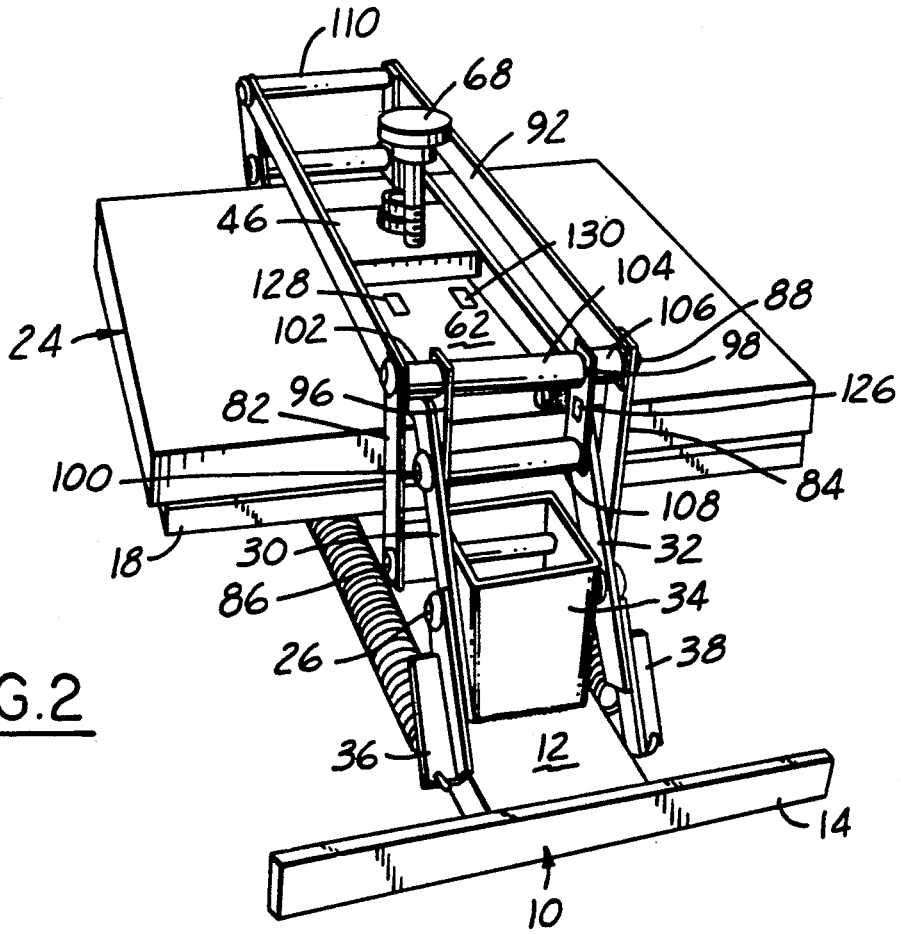
FIG. 2 is a perspective view of a heat sealing machine embodying the invention with the cover and control center altogether removed to illustrate the platen linkage.
Figure 3:
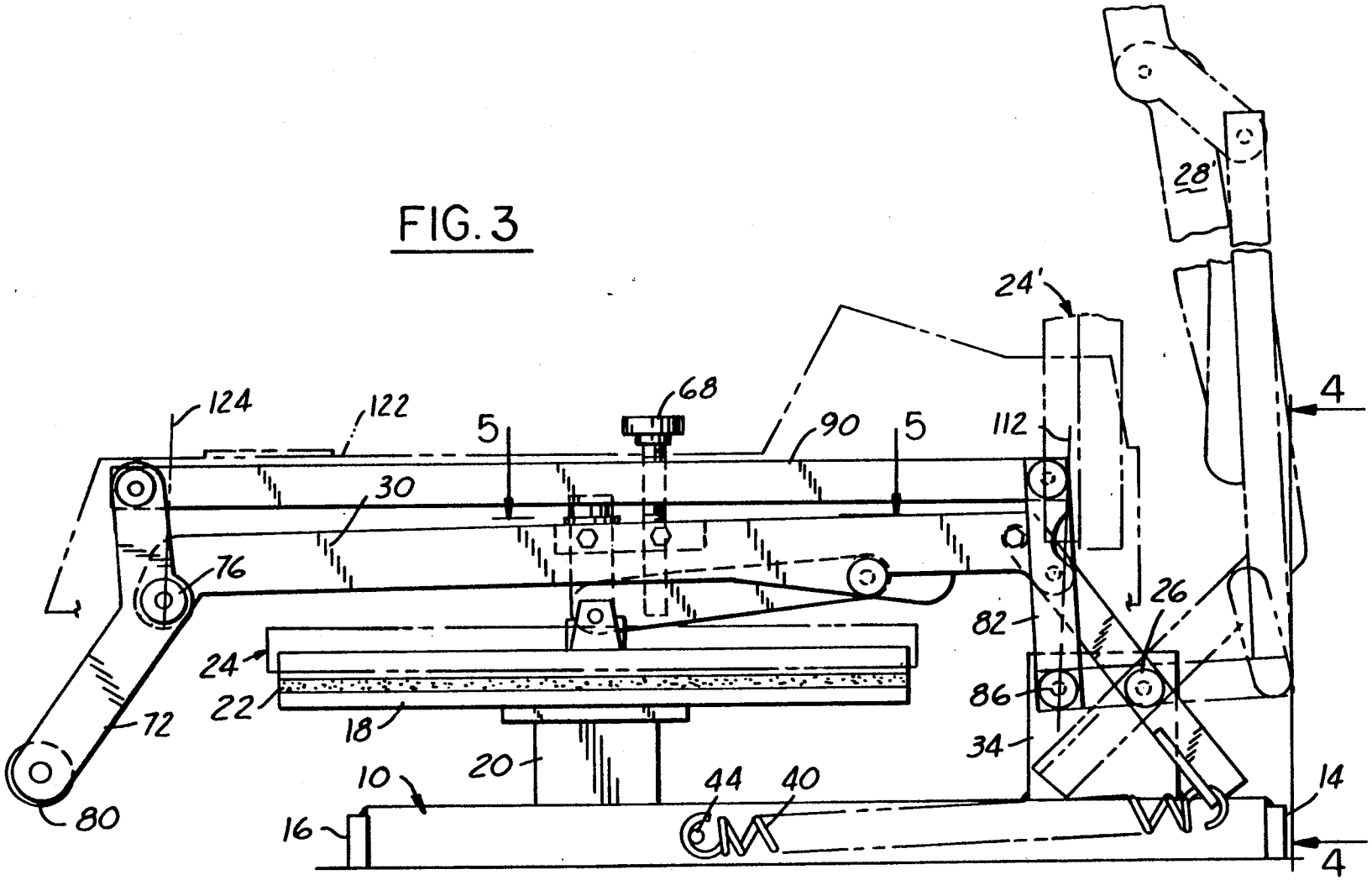
FIG. 3 is a side elevation of the heat sealing machine of FIGS. 1 and 2 showing the upper platen in solid outline superimposed on the lower platen and in phantom outline elevated to its substantially vertical position to the rear of the lower platen.

As shown in FIGS. 1-3, a heat seal machine embodying the invention comprises a base (10) having a central longitudinally extending portion (12) at opposite ends of which are laterally extending feet (14, 16). A lower platen (18) is mounted on the base on a pedestal (20) in a substantially horizontal position. Means, not shown, permit the lower plate (18) to be removed for replacement by a different size or shaped platen for particular requirements of the heat-sealing operation. A heat-resistant tetrafluoroethylene pad, such as sold under the trademark TEFLON®, (22) may be provided on top of the lower platen (18).

An upper platen (24) is mounted on the base for swingable movement about a horizontal axis (26) between a closed position superimposing lower platen (18) and an open position disposed substantially vertically to the rear of the lower platen as indicated at (24') in FIG. 3. Means are provided supporting the upper platen on the base for the aforesaid swingable movement. Such means comprises first lever arm means (28) pivotally mounted at (26) on the base and extending over the platens for swingable movement about the pivot 26 between a horizontal position and a substantially vertical position indicated at (28') in FIG. 3. The first lever arm means (28) comprises a pair of lever arms (30, 32) swingably supported on a pin (27) coincident with pivot 26 carried by a rear pedestal (34) secured to the longitudinal portion (12) of the base. The pin (27) is disposed adjacent the rear ends of the first lever arms as best shown in FIGS. 2 and 3 and a pair of laterally-extending, spring-engaging brackets (36, 38) are secured to the lever arms rearwardly of the pivot for the attachment of tension springs (40, 42). The forward ends of the springs are connected to laterally extending pins such as (44) shown in FIG. 3 secured to the base. The springs (40, 42) counterbalance some of the weight of the upper platen to relieve fatigue of the operator and also to insure that the upper platen is held in its open position (24') in FIG. 3.

Figure 6:
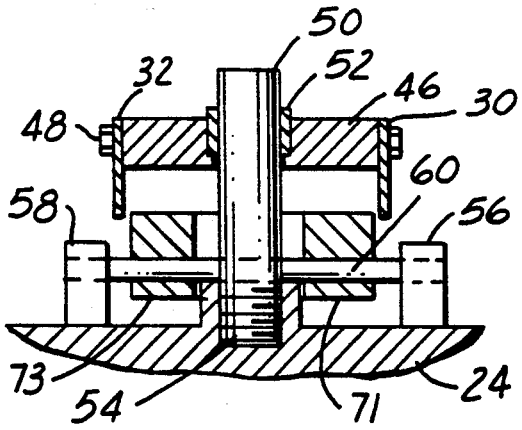
FIG. 6 is a cross-sectional view taken along the line 6—6 of FIG. 5.
Figure 7:
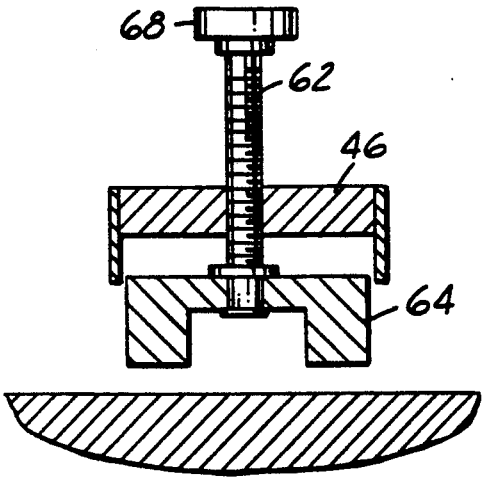
FIG. 7 is a cross-sectional view taken along the line 7—7 of FIG. 5.

A platen-supporting plate (46) best shown in FIGS. 1, 2, and 5 extends between the lever arms (30, 32) and is secured thereto by fasteners (48). A hollow post (50) extends downwardly through the plate (46) carried by a sleeve-type bearing (52) and is threaded at its lower end (54) as best shown in FIG. 6 into the upper platen (24). A pair of upstanding lugs (56, 58) integral with the upper platen (24) carry a cross pin (60) which extends through a provided hole in the post (50). The post (50) and its bearing (52) provide for movement of the upper platen perpendicular to the lever arm means (28). Perpendicular adjustment between the lever arm means (28) and the upper platen is accomplished by a manually adjustable, screw-threaded member (62) threadedly engaged in the plate (46) and retained at its lower end in a pivoted plate (64) hinged at its rear end on the pin (66) extending between and carried by the lever arms (30, 32). The retention of the threaded member (62) and the pivoted plate (64) is best shown in FIG. 7. The connection therebetween permits angular movement between the threaded member and the plate (64) as threaded member (62) is rotated to swing the free end of the plàte about its pivot (66). A suitable knob (68) is provided on the threaded member to facilitate its manual rotation.

The free end of pivoted plate (64) is provided with a pair of forwardly-extending projections or lugs (71, 73) through which the cross pin (60) extends thereby preventing rotation of platen (24) about the axis of post (50). There is enough clearance between the post (50) and its bearing sleeve (52), and between the cross pin (60) and the lugs (71, 73) that the upper platen may rock slightly as it closes against the lower platen to match the position thereof so that an even or uniform pressure is imposed on a garment and indicia to be attached thereto disposed between the platens. In this connection it will be noted that the upstanding lugs (56, 58) and the post (50) are arranged substantially at the mid-point of the upper platen measured both longitudinally and laterally thereof so that application of pressure through the lever arms (30, 32) and the threaded member (62) will be transferred to the upper platen substantially at its center of area.

At the front of the upper platen in a position to be readily grasped by the operator is a handle mechanism (70) comprising a pair of generally L-shaped handle links (72, 74) pivotally mounted on a pin (76) extending between the lever arms (30, 32) with a spacer (78) encircling the pin and extending between such arms. A hand grip (80) is secured between the links (72, 74). The handle mechanism serves not only to permit the operator to raise and lower the upper platen between the closed position superimposed on the lower platen and the open vertical position shown in phantom in FIG. 3, but also enable the application of increased pressure between the upper and lower platens and the locking of the platens together during the actual heat-sealing operation. The application of increased pressure between the platens and the locking of the platens together is accomplished by an over-center locking mechanism which is operated by the handle. Such lock mechanism is best shown in FIGS. 2, 3, and 4. In operation it serves to pull the lever arms (30, 32) downwardly toward the base carrying the upper platen firmly against the lower platen with a greater force than simply the downward closing pressure exerted by the operator on the handle.

The over-center linkage arrangement comprises a pair of long links (82, 84) pivotally connected at (86) to the pedestal (34) forwardly of the pivot (26). The upper ends of the long links are connected by a transverse pin (88) to the rear ends of actuating links (90, 92) which extend forwardly and are connected by a transverse pin (94) to the upper ends of the handle links (72, 74). A pair of short links (96, 98) are connected at their upper ends to the transverse pin (88) and at their lower ends to the long lever arms (30, 32) by a transverse pin (100). Suitable spacers (102, 104, 106) encircle the pin (88), another spacer (108) encircles pin (100) and a spacer (110) encircles pin (94) to maintain the associated links and levers in proper spaced relation as shown in FIGS. 1 and 2.

In FIG. 3 links (82, 84) are in alignment with links (96, 98) and the upper platen (24) is locked down against the lower platen. By swinging the links (82, 84) rearwardly to the imaginary line (112) shown in FIG. 3, the links (82, 84) are then misaligned from the links (96, 98) to unlock the over-center mechanism. The continued upward movement by the operator of the handle (70) will cause the upper platen to be raised such as to the position (24') in FIG. 3. Conversely, as the handle (70) is swung downwardly to carry the upper platen from its position (24') in FIG. 3 to a closed position superimposed on the lower platen (18) during the last increments of downward movement and as the upper platen encounters resistance from the lower platen the handle (70) will pivot about the pin (76) drawing the actuating links (90, 92) forwardly to swing the long links (82, 84) into alignment with the short links (96, 98) to effect over-center locking action and multiply the closing pressure between the platens.

By adjustment of the threaded member (62) by way of knob (68) the amount of pressure imposed between the platens during their locking together by the over-center mechanism may be varied as desired by the operator. Different fabrics and different indicia to be heat-sealed thereto will require different amounts of pressure to be applied to the indicia and fabrics just as the same may require different amounts of temperature and different lengths of time for effective heat sealing to occur. The knob (68) and its threaded member (62) will enable the operator to adjust the pressure as required. To limit the downward swing of the handle (70) and stop the over-center locking mechanism at its over-center position, a stop member (114) is provided as shown in FIG. 1 and in greater detail in FIG. 4. Such stop member comprises as bolt (116), extending through the long lever arm (32) and provided with an elastomeric sleeve (118) held on the bold by a nut (120). The sleeve (118)

will bear against the short link (98) as the actuating links (90, 92) are drawn forwardly by depression of the handle mechanism (70) thereby limiting the forward movement of the actuating links.

It is intended that the actuating links (90, 92), the long lever arms (30, 32) and most of the over-center locking mechanism be concealed beneath a housing (122) shown in phantom outline in FIGS. 1, 3, and 4. The housing contains the control system and provides a support for a keypad (not shown) similar to the keypad (52) in the referenced PCT application Ser. No. PCT/US88/00409, or that shown in FIG. 7 in PCT/US88/0421. In addition to the keypad, the cover supports a controller including a digital readout similar to that indicated at (46) in PCT application Ser. No. PCT/US88/00409 or in FIG. 8 in PCT/US88/04021. The controller, readout, and keypad, along with an optical switch indicating when the platens are closed to commence the timing cycle of the controller operation, may be constructed and arranged as described in connection with FIG. 7–9 inclusive of PCT application Ser. No. PCT/US88/00409 or as in PCT application Ser. No. PCT/US88/04021 to which reference should be made for an understanding thereof as all such is incorporated herein by reference. In connection with the initiation of the timing cycle, an optical sensor as mentioned in the aforesaid PCT applications is mounted as at (126) on the short link (98) (See FIG. 2) with a light transmission hole (not shown) through the link to reflect light off long link (84) back to the sensor when the links are aligned (as when the platens are closed) to initiate the timing. Pressure between the platens is sensed by a pair of strain gauges as in PCT/US88/00409 mounted as at (128) and (130) on the pivoted plate. The plate will bend slightly dependent upon the pressure between the platens, and the amount of such bending is a function of the pressure. The output of the strain gauges is delivered to the controller for processing and output as a function of pressure on the readout which may be observed by the operator.

The upper platen (24) is covered by an insulated housing. The platen itself corresponds in construction to that disclosed in the aforesaid PCT application and is provided internally with electric heating elements. A thermostat is provided for controlling the temperature of the upper platen.

In operation, the operator will turn on the system causing the upper platen to be heated. The operator will punch in on the keypad the temperature desired. When such temperature is reached the controller will cause a signal on the digital readout to be energized giving the operator a visual indication that the machine is ready for the heat seal operation at the selected temperature. The operator will then keypunch in the time interval during which the heat sealing is to be effected. While waiting for the platen to be heated to the selected temperature, the operator may gauge the pressure by opening the upper platen and placing on the lower platen the garment to be heat sealed and then closing the upper platen to read the pressure imposed on the garment between the platens. The pressure reading is derived from the pivoted plate (64) in like fashion to that in pivoted plate (27) in the aforesaid PCT application Ser. No. PCT/US88/00409. The operator may adjust the pressure to correspond to that prescribed for the heat sealing to be accomplished. When the temperature of the upper platen has reached the proper point, the operator will place the garment with the indicia to be heat sealed thereto upon the lower platen and thereafter close the upper platen thereagainst causing the over-center mechanism to lock the upper platen in place. The closure of the upper platen will institute the timing cycle as in the aforesaid PCT application. When the timing cycle times out, an audible alarm will be sounded so that the operator will be notified to open the machine and remove the heat-sealed garment.

What is claimed is:

1. A heat sealing machine comprising, in combination:

a base;

a lower platen mounted in a horizontal position on the base;

an upper platen;

said platens having front and rear sides;

means for supporting the upper platen on the base for swingable movement between a horizontal position superimposing the lower platen to a substantially vertical position rearward of the rear side of the lower platen;

means for heating the upper platen;

handle means at the front side of the upper platen supported for movement relative to the upper platen between platen locking and unlocking positions and for manually moving the upper platen as aforesaid;

said means for supporting the upper platen being connected to the handle means and responsive to the movement of the handle means relative to the upper platen from said platen unlocking to said platen locking positions for multiplying the pressure imposed between the platens during final swinging movement of the upper platen against the lower platen and locking of the upper platen against the lower platen;

said means for supporting the upper platen being responsive to movement of the handle means relative to the upper platen from the locking to the unlocking positions to release the pressure between the platens and swing the upper platen to its substantially vertical position rearward of the rear side of the lower platen; and said handle means remaining substantially at the front side of the upper platen during platen locking and unlocking movements and at both horizontal and vertical platen positions whereby said handle means is easily accessible from the front side of the lower platen to move the upper platen between the horizontal and vertical positions.

2. The heat sealing machine defined by claim 1 characterized by said means for supporting the upper platen including spring means for counterbalancing the weight of the upper platen.

3. The heat sealing machine defined by claim 1 characterized by said means supporting the upper platen including an over-center lock for holding the upper platen superimposed on the lower platen.

4. The heat sealing machine defined by claim 3 wherein means are provided for adjusting the pressure applied between the platens as the over-center lock moves to lock the platens together.

5. The heat sealing machine defined by claim 1 or 4 wherein visual readout means, responsive to the manual application of pressure across the platens, are provided for indicating the amount of pressure applied.

6. A heat sealing machine comprising, in combination:

a base having front and rear ends;

a lower platen, having front and rear sides, mounted in a horizontal position on the base;

lever arm means pivotally mounted adjacent the rear end on the base rearward of the rear side of the lower platen and swingable from a vertical position to a position overlying the lower platen;

an upper platen carried by the lever arm means for movement therewith and relative thereto;

means for locking the lever arm means in the position overlying the lower platen and overlying the upper platen whereby the platens are locked together in a locked position;

means for adjusting the position of the upper platen relative to the lever arm means independently of the pivotal support of the lever arm means on the base for varying the pressure between the platens when locked together; and handle means on the lever arm means for swinging the lever arm means as aforesaid and connected to and operating the means for locking as the upper platen is brought to a position superimposing the lower platen and the platens are locked together, said handle means disposed adjacent the front side of the upper platen during all aforesaid movements of the lever arm means whereby the handle means is easily accessible from the front side of the lower platen to move the upper platen between the horizontal and vertical positions.

7. The heat sealing machine defined by claim 6 wherein said means for locking comprises an over-center mechanism.

8. The heat sealing machine defined by claim 6 wherein said means for adjusting the position of the upper platen includes guide means connecting the upper platen to the lever arm means for imposing generally rectilinear movement therebetween.

9. In a heat sealing machine having a base with a lower platen mounted thereon and an upper platen movable toward and away from the lower platen, the lower and upper platens each having front and rear ends, a support linkage comprising:

lever arm means for carrying the upper platen, said lever arm means having front and rear ends and pivotally mounted on the base adjacent said rear end of said lever arm means and swingable between a horizontal position with the upper platen closed against the lower platen and a substantially vertical position rearward of the lower platen;

platen-adjusting means for adjusting the distance between the upper platen and the lever arm means;

handle means on the front of the lever arm means disposed in front of the front end of the upper platen for swinging the lever arm means and the upper platen between the aforesaid positions;

an over-center linkage mechanism for urging the lever arm means, and in turn the upper platen, toward the lower platen during final closure of the platens, said mechanism including a linkage having a first end pivotally connected to the base and a second end pivotally connected to the lever arm means; and actuating linkage extending between said handle means and the over-center linkage mechanism for swinging such linkage through an over-center position during final closure of the platens to lock the platens together.

10. The support linkage of claim 9 further comprising a spring means for counterbalancing the weight of the upper platen, said spring means being connected to the lever arm means and to the base.

* * * * *